US005193504A

United States Patent [19]

Konrath

[11] Patent Number: 5,193,504

[45] Date of Patent: Mar. 16, 1993

[54] FUEL INJECTION PUMP FOR INTERNAL COMBUSTION ENGINES

[75] Inventor: Karl Konrath, Freiberg/Neckar, Fed. Rep. of Germany

[73] Assignee: Robert Bosch GmbH, Stuttgart, Fed. Rep. of Germany

[21] Appl. No.: 910,373

[22] Filed: Jul. 8, 1992

[30] Foreign Application Priority Data

Jul. 11, 1991 [DE] Fed. Rep. of Germany ..... 4122879

[51] Int. Cl.[5] ..... F02D 31/00

[52] U.S. Cl. ..... 123/357

[58] Field of Search ..... 123/373, 449, 503, 357, 123/372, 365, 367

[56] References Cited

U.S. PATENT DOCUMENTS

| | | | |
|---|---|---|---|
| 4,207,845 | 6/1980 | Semmler | 123/357 |
| 4,526,146 | 7/1985 | Djordjeuic et al. | 123/357 |
| 4,569,319 | 2/1986 | Thoma | 123/357 |
| 4,656,980 | 4/1987 | Ohkoshi | 123/373 |
| 4,685,433 | 8/1987 | Djordjevic | 123/357 |
| 4,729,357 | 3/1988 | Freudenschuss et al. | 123/357 |
| 4,745,900 | 5/1988 | Thudt | 123/357 |
| 4,773,370 | 9/1988 | Koshizawa et al. | 123/357 |
| 4,922,873 | 3/1990 | Gaeti | 123/357 |
| 5,036,815 | 8/1991 | Augustin et al. | 123/357 |
| 5,080,063 | 1/1992 | Augustin | 123/357 |

FOREIGN PATENT DOCUMENTS

| | | | |
|---|---|---|---|
| 2923560 | 12/1979 | Fed. Rep. of Germany | 123/357 |
| 3243349 | 5/1984 | Fed. Rep. of Germany . | |

*Primary Examiner*—E. Rollins Cross
*Assistant Examiner*—Thomas N. Moulis
*Attorney, Agent, or Firm*—Edwin E. Greigg; Ronald E. Greigg

[57] ABSTRACT

A fuel injection pump for internal combustion engines having a supply quantity adjusting device, in which a full-load stop for the quantity adjustment can be varied by the imposition of a stepping motor, and in which idling rpm governing is possible. The adjusting device has a tensed drag lever group, which acts as the stop lever for the stepping motor. If the stepping motor should fail in the idling position, emergency operation is possible by overpressing the drag lever.

3 Claims, 2 Drawing Sheets

FUEL INJECTION PUMP FOR INTERNAL COMBUSTION ENGINES

BACKGROUND OF THE INVENTION

The invention is based on a fuel injection pump for an internal combustion engine. In one such adjusting device, known from German Offenlegungsschrift 32 43 349, a full-load stop for a quantity adjusting device of a fuel injection pump is adjusted by a stepping motor, and the quantity adjusting device is actuated by a centrifugal governor, typically present on the fuel injection pump, in combination with a load lever. The stepping motor acts directly upon the stop lever, which might have to be adjusted counter to the force of a governor spring. Another already proposed adjusting device regulates not only the maximum full-load injection quantity and the starting injection quantity but the idling injection quantity as well, as a function of engine operating parameters, via a stepping motor. If the stepping motor fails during adjusting regulation during idling, the injection quantity can no longer be increased for vehicle operation, and the engine is practically inoperative thereafter.

OBJECT AND SUMMARY OF THE INVENTION

The fuel injection pump according to the invention has the advantage over the prior art that it can continue to be operated even if the stepping motor fails. It is thus possible, even after failure of the stepping motor, to maintain actuatability of the governor lever and maintain continued operation of the fuel injection pump, thereby insuring emergency engine operation. Other advantages and advantageous features can be found in the drawings and description.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
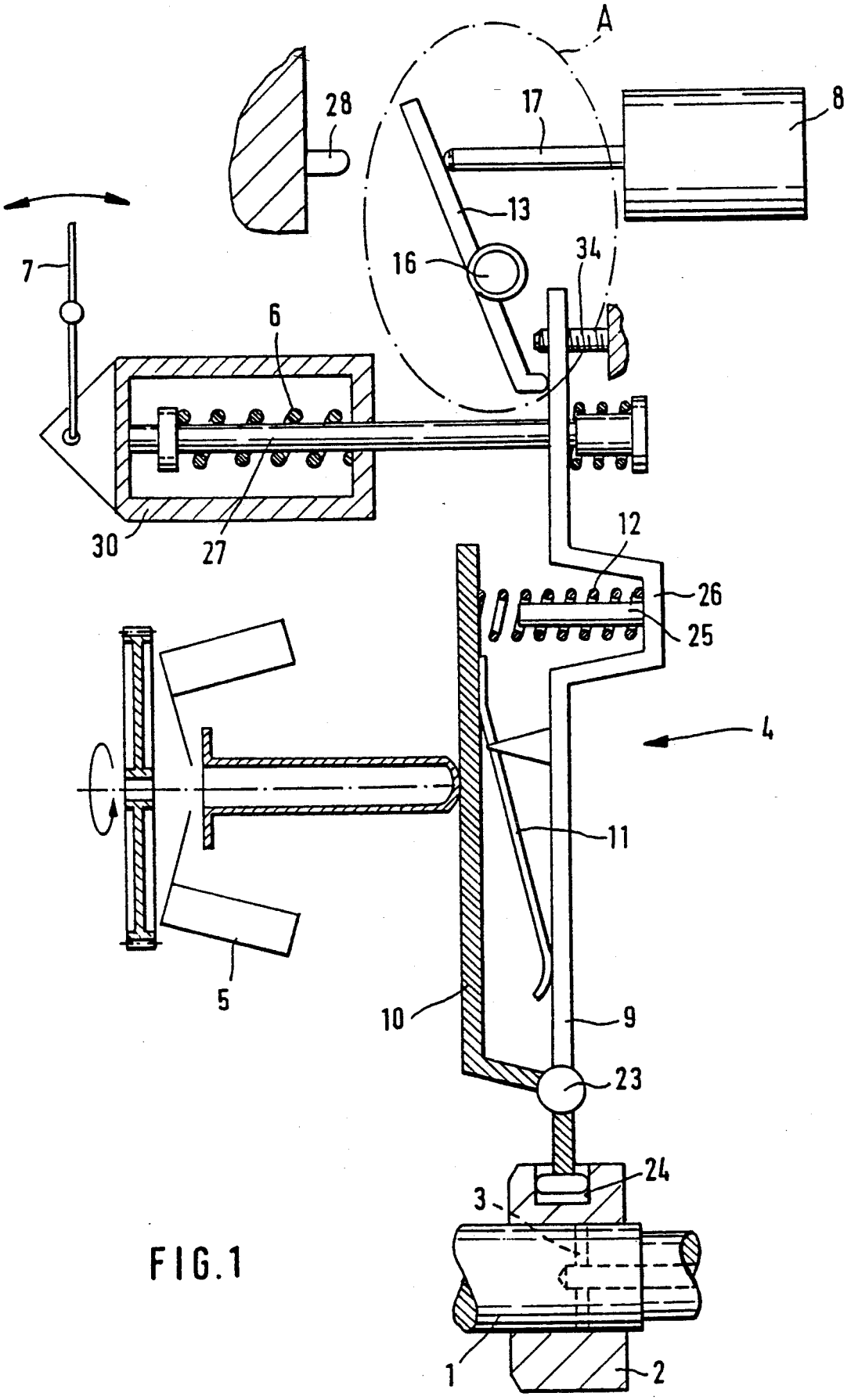
FIG. 1 is a simplified view of a fuel injection pump of an internal combustion engine, having a stop lever, which is adjustable by a stepping motor, for the governor lever as in the prior art; this is intended to explain the location and function of the double drag lever according to the invention.

The fuel quantity adjusting device 4 shown in FIG. 1 shows the structure of a known fuel injection pump for internal combustion engines. The structure and function are therefore explained only to the extent that they serve the purpose of comprehension of the subject of the invention. On a pump piston 1 that forms a pump work chamber in the high-pressure part, not shown, an annular slide 2 is provided, which via its axial motion opens a relief conduit 3 of the pump work chamber on the pump piston 1. The annular slide 2 is joined to a governor lever 10, which is adjustable by an rpm-dependent force 5 counter to the force of a governor spring 6. The rpm-dependent force is transmitted, via a centrifugal adjustor 5 operating synchronously with the pump rpm to the governor lever, embodied as a two-armed starting lever 10 which is rotatably supported on a fixed shaft 23 structurally connected to the housing and which with its lever arm remote from the centrifugal adjustor 5 engages a recess 24 in the annular slide 2. A single-armed tensioning lever 9, which is engaged by a bolt 27 and a small spring due to a force of a governor spring 6, is pivotable about this same shaft 23 structurally connected to the housing, and a starting spring 11 and an idling spring 12 are disposed between this tensioning lever 9 and the starting lever 10. After an idling rpm has been exceeded, the starting lever 10 comes into contact with the tensioning lever 9, counter to the force of the starting spring 11 and idling spring 12. The tensioning lever guides the idling spring 12 over a pin 25 disposed inside an offset U-bend 26. The governor spring 6 applies a spring force on the tensioning lever 9 via the bolt 27 and preferably comprises a pre-stressed compression spring within a housing 30; on one end of the housing, the housing is pivotably connected to an adjusting lever 7. A two-armed stop lever 13, which is rotatable about a fixed shaft 16 structurally connected t the housing and limits the pivoting motion of the tension lever 9, is disposed in the pivoting range of the tension lever 9; this stop lever 13 is adjustable by a stepping motor 8 via an adjusting device 17 up to a stop 28 structurally connected to the housing, and the lever 13 forms a stop for the tensioning lever 9. The adjusting travel of the tension lever 9 is limited by means of the stepping motor 8 and the stop lever 13, and as a result the fuel injection quantity is also limited, in accordance with the engine operating state, when the starting lever 10 is resting on the tension lever 9.

Figure 2:
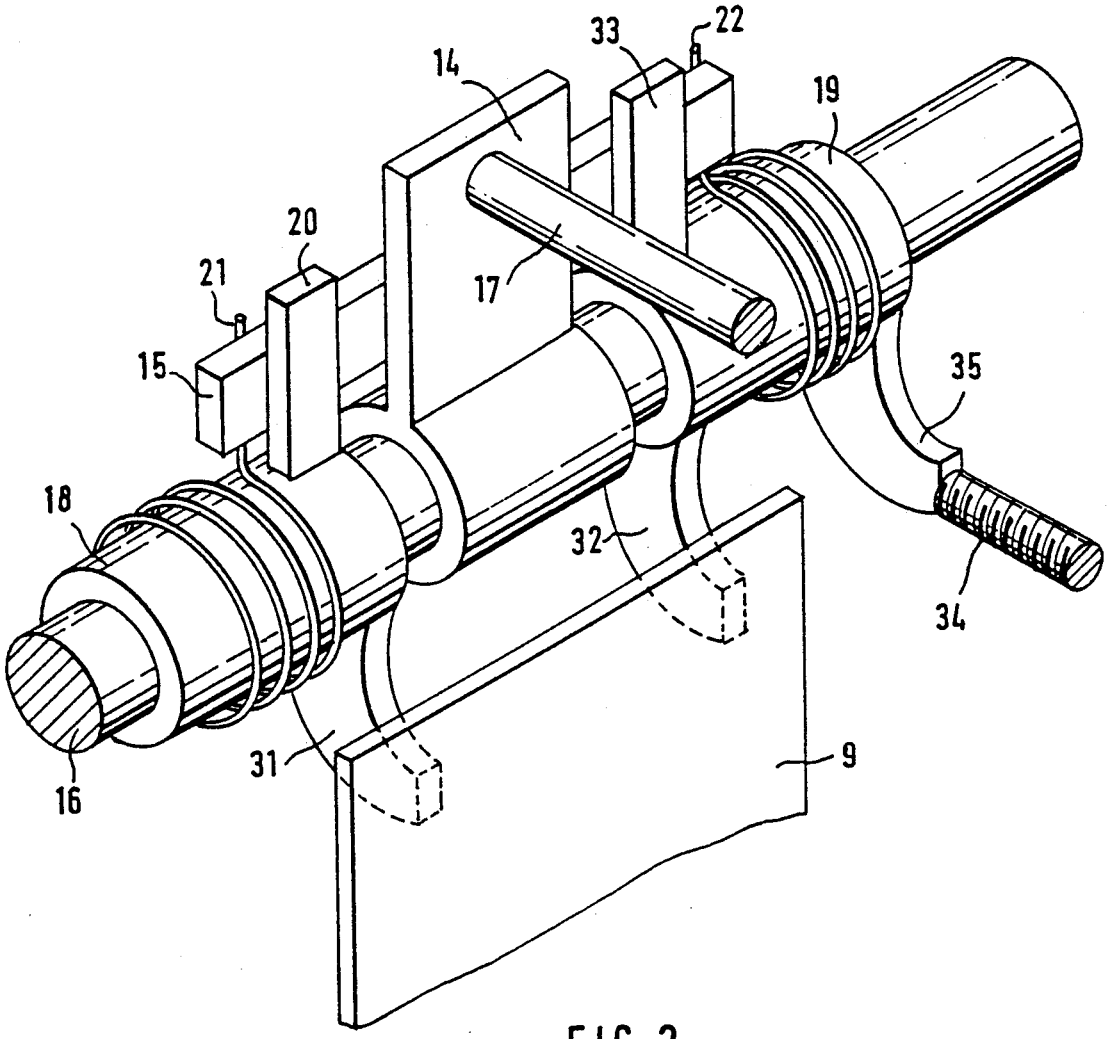
FIG. 2, in section A of FIG. 1, is a perspective view of the lever that receives the adjustable stop and is further developed according to the invention, along with the force-transmitting components adjacent to it.

Instead of a stop lever known from the prior art, the fuel injection pump of the invention has a stop level arrangement, with which blockage of the entire fuel quantity adjusting device is avoided even if the stepping motor 8 should block in the idling position. FIG. 2 shows a detailed view of the stop lever arrangement of the invention. It comprises a first drag lever 18 and a second drag lever 19, which are both supported on the shaft 16 and between which, on the shaft, a single-armed middle lever 14 is disposed, which is pivotable on the shaft 16 by the adjusting device 17 of the stepping motor 8. The first drag lever 18 is a two-armed lever, one lever arm 31 acts as a stop for the tension lever 9, and the other lever arm 20 which is supported on the first drag lever 18 and is kept in contact with a coupler element 15, disposed parallel to the shaft 16 and joined in contact with the middle lever 14, by a torsion spring 21. One lever arm 20 rests on the side of the coupler element 15 toward the adjusting device 17, and the torsion spring 21 rests on the side of coupler element 15 opposite it. The second drag lever 19 is a three-armed lever, and like the first lever the second drag lever has one lever arm 32 as a stop for the tension lever 9, and another lever arm 33 directly opposite lever arm 32, with the coupler element 15 positioned between a second torsion spring 22 and the lever arm 32. A third lever arm 35 embodied on the second drag lever is operative against an adjustable stop screw 34 that is structurally connected to the housing. The lever arm of the middle lever 14 is engaged by the adjusting device 17 of the stepping motor 8.

The fuel injection pump functions as follows: If the tension lever 9 is pressed by the governor spring 6 against the lever arms 31 and 32 of the drag levers 18 and 19, which in turn transmit the force of the governor spring, or the adjusting force exerted upon it by the adjusting lever 7, to the middle lever 14, via the coupler element 15 which is made to be a follower by the torsion springs 21 and 22, the middle lever 14 is then pressed against the adjusting device 17. Upon an adjustment of the adjusting device in the direction of a smaller fuel injection quantity, the two drag levers 18 and 19 are dragged along counter to the aforementioned adjusting force or restoring force of the governor spring 6, via the coupler element 15 and the torsion springs 21 and 22. Upon an adjustment of the adjusting device 17 in the opposite direction, the drag levers 18 and 19 follow the pivoting motion of the middle lever 14, under the influence of the adjusting force of the governor spring 6. The interconnected lever assembly behaves like a single lever. Upon a return to the idling position, or in other words when the adjusting device 17 of the stepping motor 8 is extended, the second drag lever 19, with its third lever arm 35, comes to rest on the stop screw 34 for the minimum full-load quantity and remains in that position. The stepping motor 8 overpresses the torsion spring 22 of the second drag lever 19 and presses the middle lever 14, with the tensed first drag lever 18, into the idling position. If the stepping motor 8 then blocks in this position because of some malfunction, then the tension lever 9 can be pressed against the first drag lever 8 by the adjusting lever 7, whereupon the lever arm 20 lifts away from the coupler element 15. The governor spring 7 then has a greater spring force than the torsion spring 21 on the first drag lever 18. The limitation of this emergency adjustment is affected after contact of the tension lever 9 with the first lever arm 32 of the second drag lever 19, which with its third lever arm 35 is in contact with the stop screw 34. The force of the governor spring 6 is now no longer adequate to overcome both torsion springs 21, 22. With this drag lever arrangement, instead of a single two-armed stop lever 13, it is possible to achieve a somewhat greater injection quantity after blocking of the stepping motor in the idling position, and thus to assure emergency engine operation in that situation.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines having a fuel injection quantity adjusting device (2), which cooperates with a pump piston (1) and is actuatable by a governor lever (9, 10) that is adjustable counter to a force of a governor spring (6) by an rpm-dependent force (5), wherein the adjustment travel of the governor lever (9, 10) is limited by a stop lever assembly (13) that is adjustable by means of a stepping motor (8), the stop lever assembly comprises a first drag lever (18) and a lever (14), disposed parallel to said drag lever, said lever (14) is adjustable by the stepping motor, and said first drag lever is positively coupled to said lever (14) by means of a first spring (21).

2. A fuel injection pump as defined by claim 1, in which the stop lever assembly comprises three levers, the lever (14) being acted upon by the stepping motor being positively connected via a coupler element (15) to said first and a second drag lever (18, 19), by contact in one rotational direction and rotational in an opposite direction by said first and a second spring (21, 22).

3. A fuel injection pump as defined by claim 2, in which the first and second drag levers (18, 19) are each held against the coupler element (15) by said first and second springs (21, 22), counter to the direction they can be lifted away from the coupler element (15) in the direction of the adjusting motion of the governor lever (9, 10) for a greater fuel injection quantity, under the influence of a governor lever adjusting spring (6); and the whereby second drag lever (19) has a third lever arm (35), which can be placed in contact with an adjustable stop (34), by means of which the adjusting travel of the second drag lever (19), in the direction of reducing the fuel injection quantity, is limited.

* * * * *